US007681268B2

(12) United States Patent
Johnson

(10) Patent No.: US 7,681,268 B2
(45) Date of Patent: Mar. 23, 2010

(54) FEATHERBED WITH HOURGLASS CONSTRUCTION

(75) Inventor: Barbara K. Johnson, Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 11/567,575

(22) Filed: Dec. 6, 2006

(65) Prior Publication Data

US 2008/0134441 A1 Jun. 12, 2008

(51) Int. Cl.
*A47C 17/00* (2006.01)

(52) U.S. Cl. ..... 5/690; 5/691; 5/950

(58) Field of Classification Search ..... 5/690–691, 5/502, 950, 486, 482
See application file for complete search history.

(56) References Cited

U.S. PATENT DOCUMENTS 44,223 A 9/1864 Schott
1,123,345 A 1/1915 Micon
4,208,748 A 6/1980 Lobach
4,292,702 A * 10/1981 Phillips ..... 5/683
5,187,825 A 2/1993 Tesch
5,299,333 A 4/1994 Pedersen
5,459,894 A 10/1995 Buonocore
5,987,669 A 11/1999 Leggett
6,643,872 B1 11/2003 Buswell
6,961,970 B2 * 11/2005 Pedersen ..... 5/502

* cited by examiner

*Primary Examiner*—Fredrick Conley
(74) *Attorney, Agent, or Firm*—Clark A. Puntigam; Jensen & Puntigam, P.S.

(57) ABSTRACT

The featherbed includes upper and lower outer fabric sections, which are substantially identical in configuration, secured together along their respective longitudinal and end edges. A plurality of baffle members extend between and are secured to the upper and lower layers substantially from end to end of the featherbed. The baffle members are arranged in pair forms a substantially hourglass configuration.

5 Claims, 2 Drawing Sheets

FIG.1
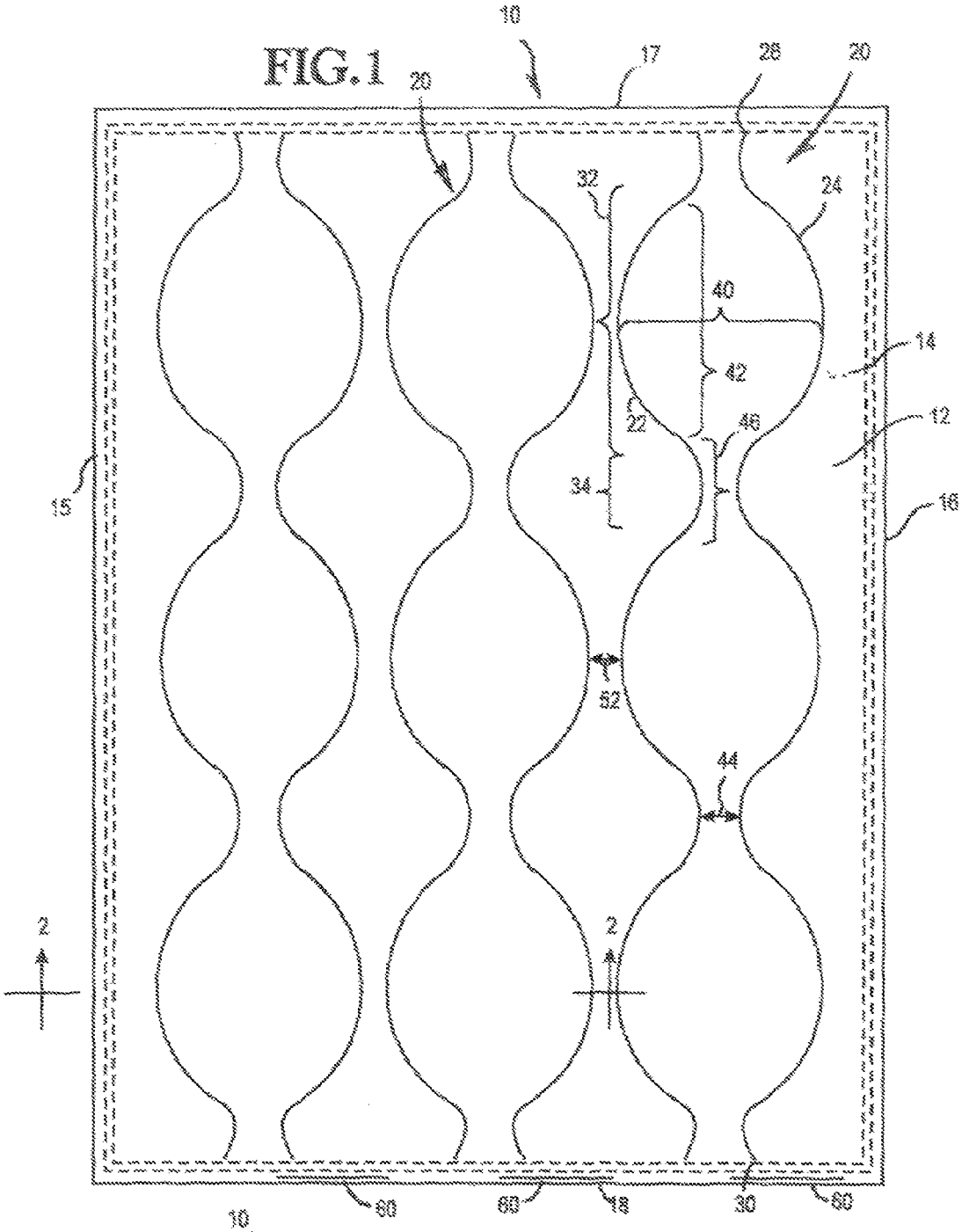
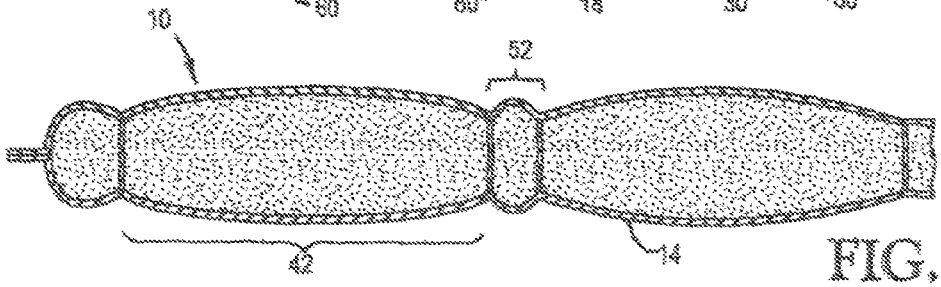
FIG.2

FEATHERBED WITH HOURGLASS CONSTRUCTION

TECHNICAL FIELD

This invention relates generally to featherbeds, and more specifically concerns a new internal construction for a featherbed.

BACKGROUND OF THE INVENTION

Featherbeds typically have an internal baffle or sewn-through construction which prevents to some extent migration of the filling during use of the featherbed. When a user is lying on the featherbed, the heavier portions of the body tend to force the filling in that area into other area of the featherbed. While baffles can be effective in decreasing filling migration, their effect is limited by the need to be able to effectively blow-in, i.e. fill, the featherbed.

In one conventional arrangement, the baffles are straight, in a longitudinal (vertical) direction, defining longitudinal channels in the featherbed. This arrangement is convenient to fill but is limited in preventing filling migration.

Another common arrangement is known as baffle box construction, in which baffles extend both longitudinally and partially laterally, leaving small openings for insertion of filling. This arrangement is more difficult to properly fill, but also is better in preventing filling migration.

While such baffle arrangements differ in preventing filling migration, there does result a consistent disadvantage for the user with such baffle configurations; he/she will often end up positioned in one of the longitudinal crevices created by the sewing line which attaches the longitudinal baffle to the outer fabric layers.

Accordingly, it is desirable to have a featherbed with an internal construction which prevents migration of fill within the featherbed during use, while still being convenient to fill during manufacture, and which does not have the straight longitudinal sewing line crevices in which the user will eventually become positioned during sleep.

DISCLOSURE OF THE INVENTION

Accordingly, the present invention, in one embodiment, comprises: upper and lower outer fabric layers, substantially identical in configuration and secured together along their respective longitudinal and end edges; a plurality of connections between the upper and lower layers, each connection having an undulating configuration from end-to-end thereof, in one direction of the featherbed, wherein the connections are spaced apart in the orthogonal dimension of the featherbed; and loose filling positioned within the featherbed between the individual connections and the outer fabric layers.

BRIEF DESCRIPTION OF THE DRAWINGS

FIG. 1 is a top view showing the featherbed construction described herein.

FIG. 2 is a cross-sectional view of the featherbed of FIG. 1, taken along lines 2-2 thereof.

BEST MODE FOR CARRYING OUT THE INVENTION

Figure 3:
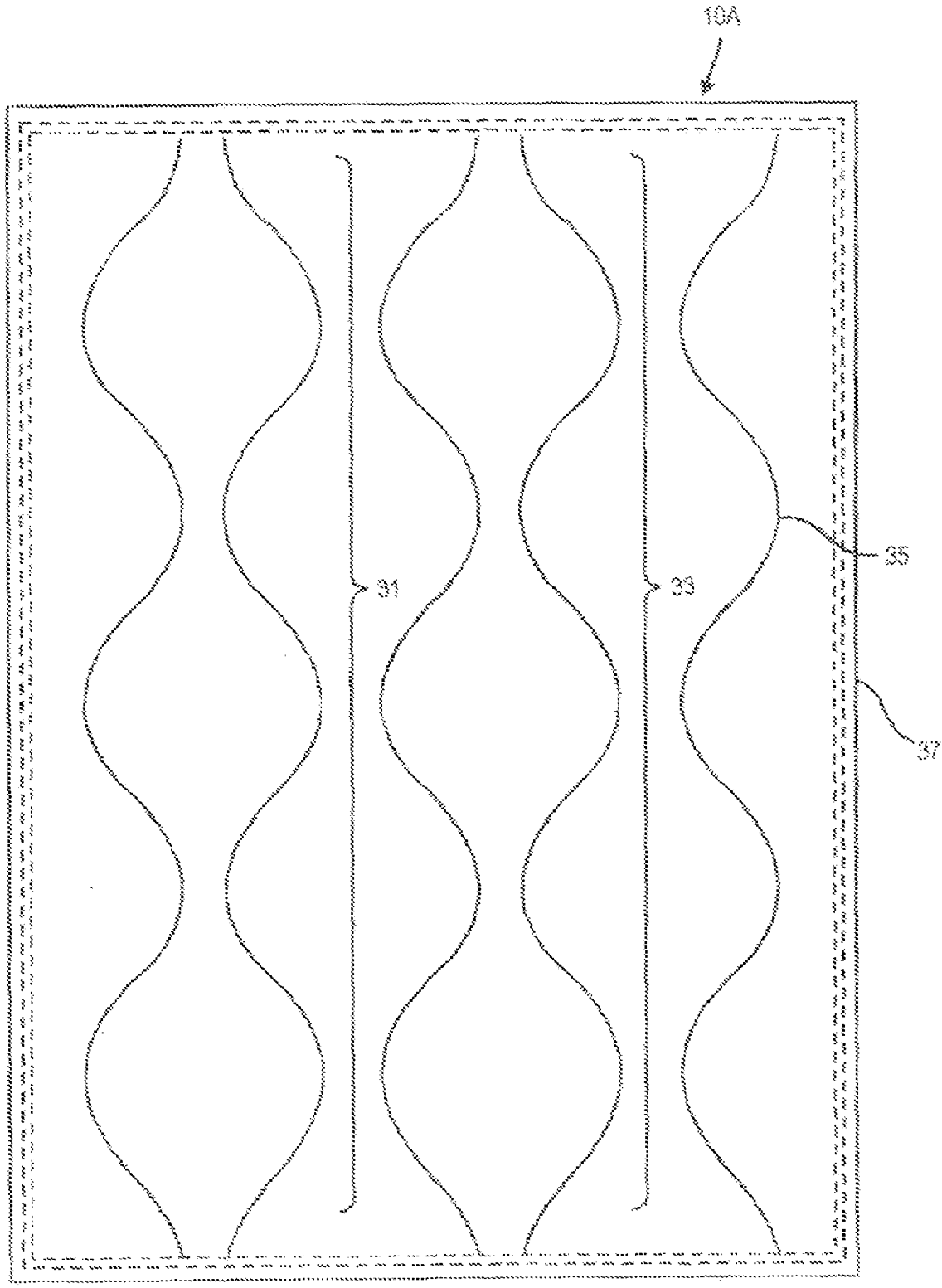
FIG 3 is a top view showing a different size featherbed from that of FIG. 1.

FIG. 1 shows a featherbed 10. Featherbed 10 includes upper and lower substantially identical fabric sections 12 and

14. The fabric sections 12 and 14 are of a desired size to fit on conventional mattress sizes. Typically, dimensions of the featherbed will be approximately equal to the top surface dimensions of the mattress, i.e. a queen-size mattress, will require a similarly sized featherbed.

In the finished featherbed, fabric sections 12 and 14 will be secured together along their respective longitudinal and end edges 15, 16 and 17, 18. In an alternative embodiment, a fabric gusset can be positioned between the longitudinal and end edges of the two fabric sections. The gusset can vary in height, as described in more detail hereinafter.

Positioned internally of the featherbed, secured to the upper and lower fabric sections 12 and 14, are a plurality of baffle assemblies 20. Each baffle assembly includes two substantially identical baffle members, for example, baffle members 22 and 24. Individual baffle members 22 and 24 are typically made from soft, compressible material, such as cotton, polyester, non-woven polypropylene and polyester netting, and are sewn to the upper and lower fabric sections 12, 14. They extend for substantially the entire length of the featherbed. The baffle assemblies could also extend laterally, across the featherbed as an alternative to the longitudinally extending baffle member.

The baffle members 22 and 24 have an opposing undulating arrangement between the two ends 28 and 30. At the edges of the featherbed, only one undulating baffle member may be present, with the edge of the featherbed 10 A forming the other side of the baffle assemblies, as illustrated by baffle assemblies 31 and 33 in FIG. 3, with baffle member 35 and longitudinal edge 37 forming half-hourglass assemblies. The opposing undulations define a plurality of hourglass-like assemblies along the length of the featherbed, as illustrated in FIG. 1, or half-hourglass assemblies for a single baffle member and the edge of the featherbed. Typically, the baffle members will be 2 inches high, although they could be higher, up to 5 inches, or shorter, down to ½ inch, for instance. Typically if the featherbed has gussets, the gusset will be the same or in some cases a little greater than the baffle height.

In a featherbed, there will be typically be a plurality of baffle assemblies, depending upon the width of the featherbed. The embodiment of FIG. 1 illustrates three identical baffle assemblies, comprised of individual baffle members, spaced at equal intervals across the featherbed. The relative dimensions of the baffle assemblies are important to the functionality and comfort of the resulting featherbed. In the embodiment shown, each baffle assembly alternated along its length between enlarged portions 32, which tend generally to be somewhat circular or elliptical in configuration, with narrow, relatively short portions 34, which define necked or "choke" regions joining adjacent enlarged portions. The arrangement of FIGS. 1 and 2 are for a queen-sized bed, while FIG. 3 is for a double bed. In the double bed arrangement, there are two full hourglass baffle assemblies and one half-hourglass assembly. The actual number of hourglass assemblies for a particular size featherbed, however, can vary, i.e., the number of baffle assemblies in the queen-size featherbed of FIG. 1 can be different than three.

In the embodiment shown in FIG. 1, the width dimension 40 of the enlarged portions will be approximately 18 inches, while the length dimension 42 thereof will be approximately 15 inches. The width dimension 44 of the narrow portions will be approximately 4½ inches, while the length dimension 46 of the narrow portions 48 will be approximately 5 inches. It should be understood, however, that these dimensions are for illustration and can be varied, as long as the desired functions and results of the embodiment are retained. The narrow portion function as "choke" points, which after filling, tend generally to significantly reduce migration of the filling in the longitudinal (vertical) direction. The width dimension of the narrow regions must be great enough, however, to permit convenient "blow-in" filling of the featherbed. A maximum width of the narrow portion will be approximately 6 inches, while a minimum would be approximately 2½ inches.

In addition to the dimensions of each baffle assembly, adjacent baffle assemblies are separated by approximately 4½ inches at dimension 52. This distance is determined by similar considerations of filling and prevention of filling migration. A suitable range is 2½ inches to 6 inches.

As described above, and as shown in the drawings, the resulting baffle assembly configuration has the appearance of an hourglass, or half-hourglass. However, it should be understood that this arrangement may vary to some extent, and that the baffle assemblies need not be in the form of a precise hourglass. It is important, however, that there be choke points along the length of the baffle assemblies to lessen migration of filling in the longitudinal direction. The same is true for the relative arrangement of adjacent baffle assemblies.

The undulating baffle assembles, besides limiting migration of filling, provide the significant advantage of eliminating a straight longitudinal crevice into which the sleeper will typically come to a position in during sleep. The user thus has the entire featherbed (or significant portion thereof) to use during sleep. This will lead to a more comfortable sleep for the user, while providing the comfort of a featherbed.

In the construction of the featherbed, the individual baffle members are sewn in the pattern shown to the upper and lower fabric sections 12 and 14, creating internal volumes between them. The respective opposing longitudinal edges 15 and 16 and one end edge 17 are then sewn closed. The other end edge 18 is partially sewn closed. The desired fill is then blown into the featherbed through the openings 60 in end edge 18. The filling proceeds through all the open areas, including all the choke points in the longitudinal dimensions of the featherbed, including the volume within each hourglass assembly and the volumes between the hourglass assemblies, resulting in an evenly distributed fill throughout the entire featherbed.

The filling may vary, including feathers, down or a combination thereof, as well as polyester particles, or a combination of polyester, feathers and/or down. After the filling step is completed, and edge 18 is sewn completely closed (the openings 60 are closed) and the featherbed is ready for use.

Accordingly, a featherbed with a new internal baffle construction has been shown and described. The new construction decreases migration of fill within the featherbed relative to conventional straight channel or box construction, but also eliminates straight sewing crevices between adjacent channels, thereby increasing the overall comfort of the featherbed for the user. While the baffle assemblies are shown extending in the longitudinal direction of the featherbed, they could alternatively extend in the lateral direction (across the featherbed). While the featherbed shown is constructed with baffles, a sewn-through construction can also be used. The term "connections" between the upper and lower fabric sections is intended to cover baffles, sewn-through lines of the stitching and other means of securement to produce the desired undulating connection arrangement.

Although a preferred embodiment of the invention has been disclosed for purposes of illustration, it should be understood that various changes, modifications and substitutions may be incorporated in the embodiment without departing from the spirit of the invention which is defined by the claims which follow.

What is claimed is:

1. A featherbed, comprising;

upper and lower outer fabric layers, substantially identical in configuration and secured together along their respective longitudinal and end edges;

a plurality of solid connections between the upper and lower layers, each connection having an undulating configuration from end-to-end thereof, in one direction of the featherbed and extending to opposing edges of said featherbed, thereby preventing communication between adjacent internal volumes between the solid connections, wherein the connections are spaced apart in the orthogonal dimension of the featherbed, wherein the connections are positioned in pairs having opposing undulating configurations, generally in the form of hourglass arrangements which include enlarged portions and narrow portions alternating along the length thereof, the enlarged portions being at least three times as wide as the narrow portions, wherein the narrow portions are at least 2½ inches wide to restrict migration of solid filling within the internal volumes while permitting loose solid filling to be blown in to fill the internal volumes; and loose solid filling positioned within the featherbed between the individual connections and the outer fabric layers.

2. The featherbed of claim 1, wherein the connections are in the form of fabric baffles which are secured along the lengths thereof to the upper and lower fabric sections.

3. The featherbed of claim 1, wherein the one direction is the longitudinal direction of the featherbed.

4. The featherbed of claim 1, wherein the connections are substantially continuous along the length thereof.

5. The featherbed of claim 1, wherein the narrow portions are approximately 4½ inches wide and approximately 5 inches long, while the enlarged portions are approximately 18 inches wide and approximately 15 inches long.

* * * * *